US010702766B1

(12) United States Patent
Wang

(10) Patent No.: US 10,702,766 B1
(45) Date of Patent: Jul. 7, 2020

(54) NUMBER PUZZLE BOARD GAME

(71) Applicant: Yi Wang, Amherst, NY (US)

(72) Inventor: Yi Wang, Amherst, NY (US)

( * ) Notice: Subject to any disclaimer, the term of this patent is extended or adjusted under 35 U.S.C. 154(b) by 0 days.

(21) Appl. No.: 16/225,596

(22) Filed: Dec. 19, 2018

(51) Int. Cl.
*A63F 3/00* (2006.01)
*A63F 3/04* (2006.01)

(52) U.S. Cl.
CPC ..... *A63F 3/0415* (2013.01); *A63F 3/00261* (2013.01); *A63F 2003/00507* (2013.01); *A63F 2003/0418* (2013.01)

(58) Field of Classification Search
CPC ..... A63F 3/0415; A63F 3/00261; A63F 2003/00507; A63F 2003/0418
USPC ..... 273/271, 272
See application file for complete search history.

(56) References Cited

U.S. PATENT DOCUMENTS 3,113,778 A * 12/1963 Silverman ..... G07C 15/003 273/123 R
4,019,744 A * 4/1977 Pizur, Sr. ..... A63F 3/065 273/269
4,385,763 A * 5/1983 Moscovich ..... A63F 7/044 273/123 R
4,463,952 A 8/1984 Rowbal
5,413,350 A * 5/1995 Taylor ..... A63F 3/00643 273/269
5,601,288 A * 2/1997 White ..... A63F 3/00 273/271
5,615,886 A * 4/1997 Chalfin ..... A63F 3/0423 273/272
5,938,201 A * 8/1999 Gulliver ..... A63F 3/0415 273/261
6,325,374 B1 * 12/2001 Burger ..... A63F 3/00 273/236
6,702,288 B1 3/2004 Ohman
7,677,564 B2 3/2010 Kriger
2005/0130726 A1 6/2005 Stewart
2008/0084025 A1 * 4/2008 Oliphant ..... A63F 3/0415 273/153 R
2010/0148438 A1 * 6/2010 Amos ..... A63F 3/0415 273/148 R
2010/0236929 A1 * 9/2010 Pollack ..... B01L 3/50273 204/450
2017/0296911 A1 * 10/2017 Kunz ..... A63F 3/0415
2018/0353843 A1 * 12/2018 Brown ..... A63F 3/02

FOREIGN PATENT DOCUMENTS

CN 201482148 U * 5/2010

* cited by examiner

*Primary Examiner* — Vishu K Mendiratta
(74) *Attorney, Agent, or Firm* — Vincent G. LoTempio; David T. Stephenson

(57) ABSTRACT

A puzzle game including a number map having a 9×9 grid filled 9 number sets, where each number set includes the numbers 1 through 9. The 9 number sets form unique shapes comprised of 9 grid squares, where each number from each number set is connected at a side of a square in the grid to the other numbers in the set. Corresponding to each number set is a tile group comprised of 9 transparent tiles of the same color, where each tile group is a different color. To solve the puzzle every tile must be placed adjacent a tile of the same color within a single number set. Same color tiles must be placed on a different number within a single number set. The puzzle is solved when each number set is covered by tiles of the same color and the grid completely covered by tiles.

8 Claims, 12 Drawing Sheets

NUMBER PUZZLE BOARD GAME

BACKGROUND

The puzzle kit disclosed herein, in general, relates to number puzzles. More particularly, the number puzzle kit disclosed herein relates to selecting numbers to solve a puzzle on a board.

Puzzles, as a test of skill and intelligence, have been in existence for centuries. Puzzles are an enduring form of entertainment and come in a wide variety of categories. Puzzles may come in the form of jigsaw puzzles, picture puzzles, number puzzles, word puzzles, logic puzzles and more. Despite these types of puzzles being in existence in many different cultures and time periods, innovation in puzzle creation has continued.

Sudoku is a logic-based number puzzle game that started to become popular around 1986. The objective of Sudoku is to fill a 9×9 grid with digits so that each column, each row, and each of the nine 3×3 sub-grids that compose the grid contains all of the digits from 1 to 9. The puzzle setter provides a partially completed grid, which for a well-posed puzzle has a single solution.

Number puzzles first became popular in the late 19th century, when French puzzle setters began experimenting with removing numbers from magic squares. Le Siécle, a Paris daily, published a partially completed 9×9 magic square with 3×3 sub-squares on Nov. 19, 1892. It was not a Sudoku because it contained double-digit numbers and required arithmetic rather than logic to solve, but it shared key characteristics: each row, column and sub-square added up to the same number.

Completed Sudoku games are always a type of Latin square with an additional constraint on the contents of individual regions. For example, the same single integer may not appear twice in the same row, column, or any of the nine 3×3 subregions of the 9×9 playing board. In combinatorics and in experimental design, a Latin square is an n×n array filled with n different symbols, each occurring exactly once in each row and exactly once in each column.

U.S. Pat. No. 7,677,564 to Kriger discloses a Sudoku-Type Puzzle Board Game and Method of Play. A game apparatus is provided for one or more players having a first game member that includes a puzzle or a game area having indicia forming a grid having sub-grids including a plurality of cells. Each cell is assigned indicia in a solution pattern of the puzzle such that a distinct indicium appears once in each row, column, and sub-grid. The first game member displays the solution indicia for some of the cells and the remaining cells are divided into a number of sub-cells bearing the possible solution indicia for the corresponding cell such that each sub-cell includes a distinct indicium. A player speculates which sub-cell bears the correct solution indicia for the respective cell. The apparatus further includes at least one game piece adapted to randomly display an indicium when manipulated, the indicia modifying a game parameter such as a player's score or number of possible speculations the player can make in one turn.

Puzzle games where a board having a grid for the placement of tiles have achieved great popularity. Scrabble® is an example of a tile placement word tile game. U.S. Pat. No. 5,615,886, Chalfin discloses a word forming board game with colored transparent tiles. A board game wherein the playing board has color-coded sides and color chips having each side color-coded are placed by opposing players on the playing board adjacent to other color chips and the color-coded sides of the board so that the colors of each adjacent chip match one another and so that the color of each chip which is adjacent to a color-coded side of the board also matches the color-coded side.

As evidenced by the success of Sudoku and the proliferation of logic-based number puzzles, demand for new types of puzzles for new generations to call their own, a need exists for genuinely new types of number puzzles.

SUMMARY

The present disclosure includes a number map, which may be a printed on a square sheet of paper. Within the square is, in a preferred embodiment, a 9×9 grid, or number map, filled with numbers. The numbers consist of 9 number sets, where each number set includes the numbers 1 through 9. Unlike Sudoku type games, the present disclosure does not require that each row, column and sub square add up to the same number. Rather, in the present disclosure, the 9 numbers form unique shapes comprised of 9 squares on the grid, where each number from each number set is connected at an edge of a square in the grid to the other numbers in the set. The 9×9 grid leads to a total of 81 square within the grid.

The game includes 9 tile groups, comprised of 9 tiles each, where each tile group is a different color. In one embodiment, the colored tiles are transparent. To solve the puzzle every tile must be placed on the board and every tile must be placed adjacent a tile of the same color. Each tile of the same color must be placed on a different number in a particular group of colored transparent tiles, where each group of colored transparent tiles is comprised of the numbers 1 through 9. Each number having the same value on the number map must be covered by a transparent tile of a different color. Only one transparent colored tile per grid number, which consists of a single number in a square on the grid, is permitted.

For example, a red tile group would be comprised of nine transparent red tiles and would be placed on a group of colored transparent tiles comprising the numbers 1 through 9 on a number map, such that each red tile was adjacent another red tile on the 9×9 grid. To solve the puzzle, this process is repeated for each of the 9 groups of colored transparent tiles until all 81 squares on the grid are matched with colors according to the rules of the puzzle game. There exists only one solution to each puzzle of the present disclosure, however, puzzles having different solutions, or number locations, may be generated, providing virtually endless possibilities for new puzzles to be solved.

A tile cover may be placed over the tiles to secure them once the puzzle is solved to secure the tiles in place, while allowing the tiles to be visible through the tile cover. The door of the case may then be closed and secured with a latch. A window in the door allows the solved puzzle to be displayed for the viewers as a wall decoration or trophy.

BRIEF DESCRIPTION OF THE DRAWINGS

With regard to FIG. 1, a top view of a number puzzle kit is shown.

With regard to FIG. 2, a perspective view of a number puzzle kit is shown.

Figure 3:
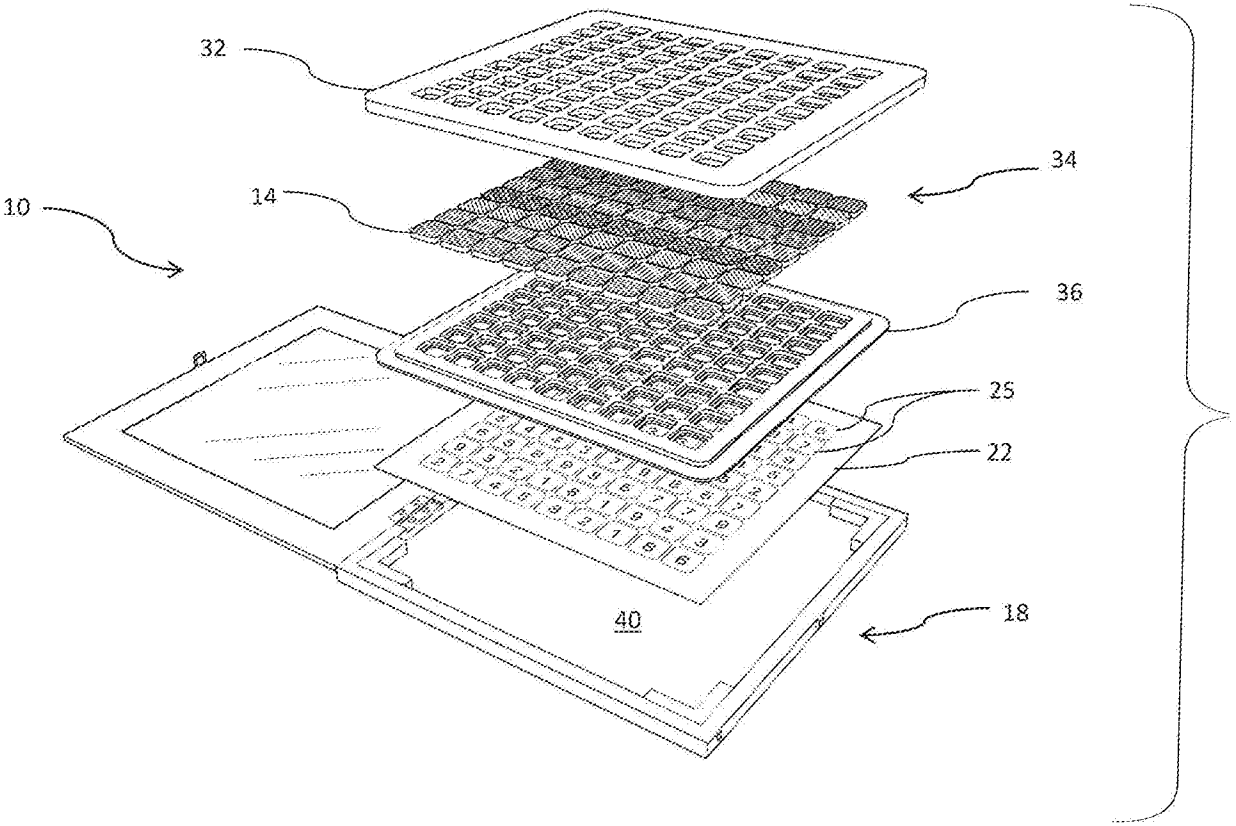

With regard to FIG. 3, an exploded perspective view of a number puzzle kit is shown.

Figure 4:
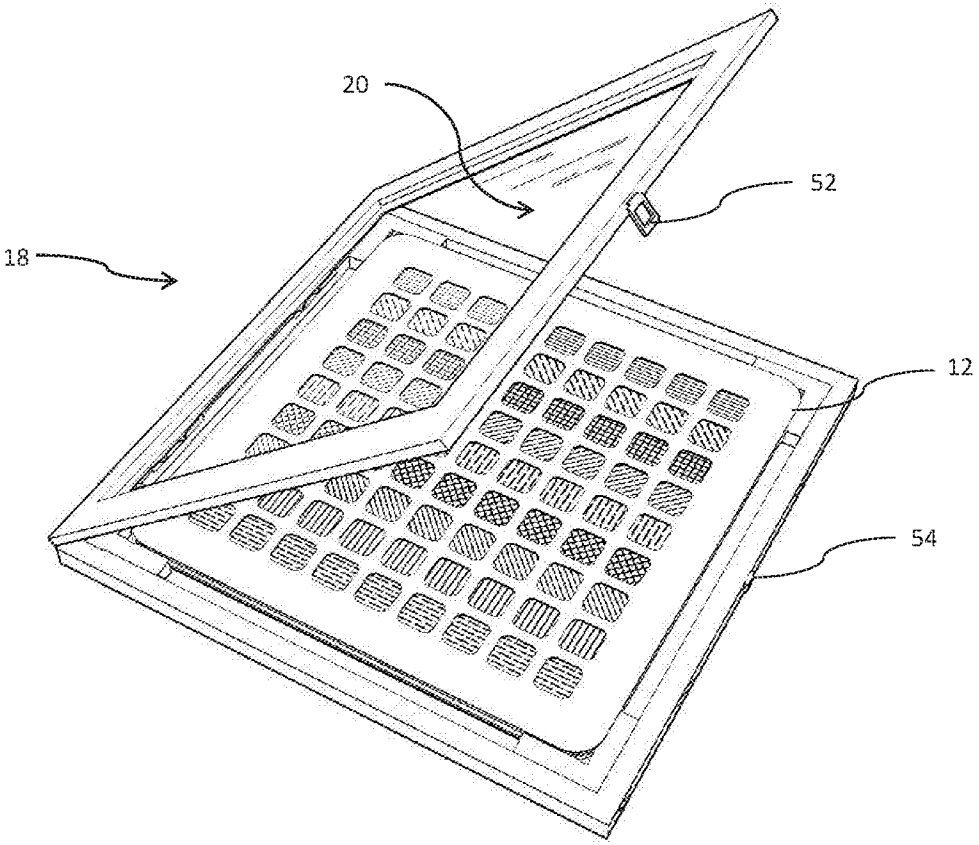

With regard to FIG. 4, a perspective view of a case containing transparent colored tiles beneath a grid cover is shown.

Figure 5:
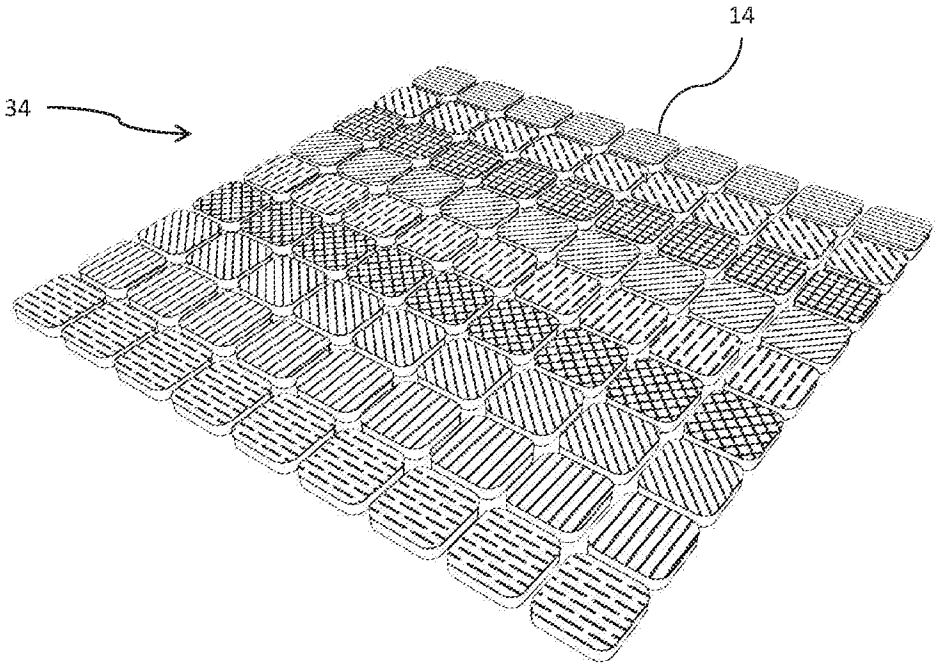

With regard to FIG. 5, a perspective view of a set of multi-colored transparent tiles is shown.

Figure 6:
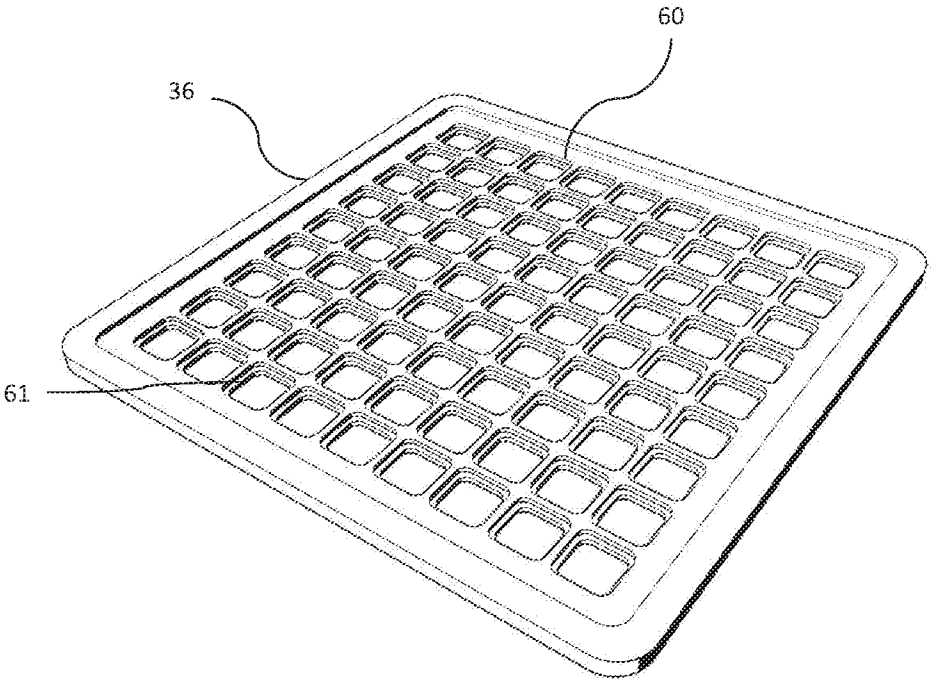

With regard to FIG. 6, a perspective view of a grid pad is shown.

Figure 7:
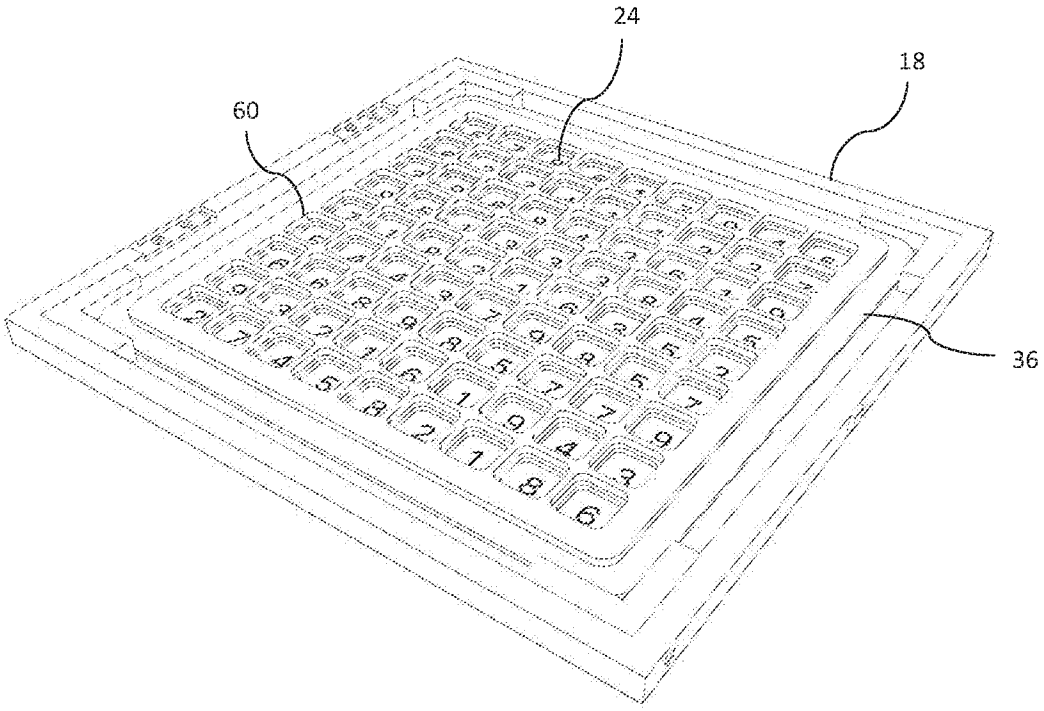

With regard to FIG. 7, a perspective view of a grid pad covering a number map is shown.

Figure 8:
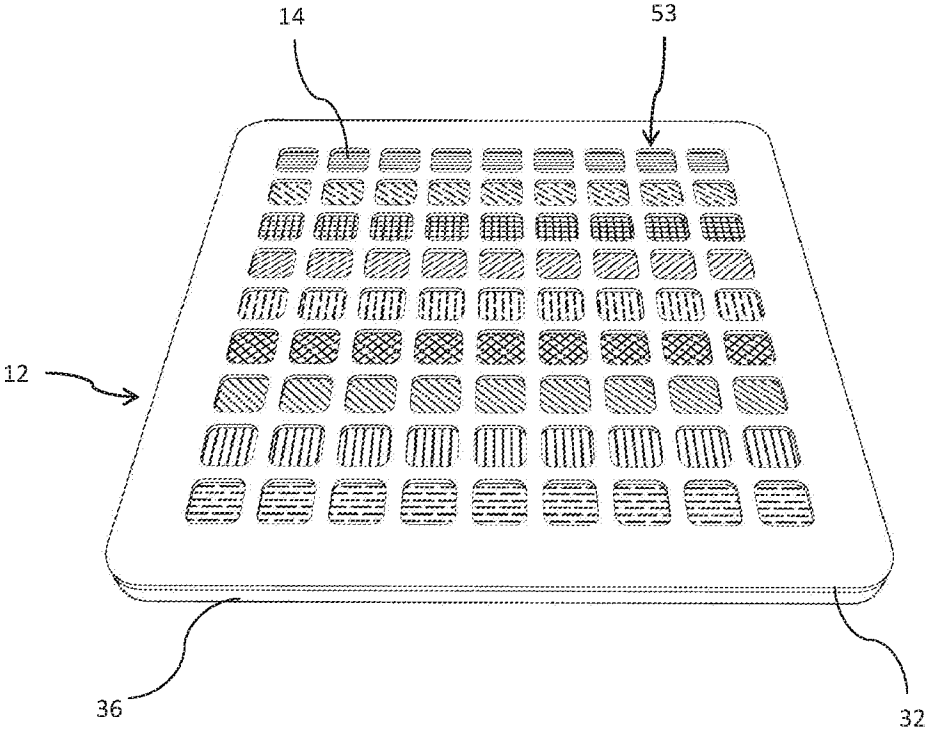

With regard to FIG. 8, a perspective view of a grid cover covering transparent tiles is shown.

Figure 9:
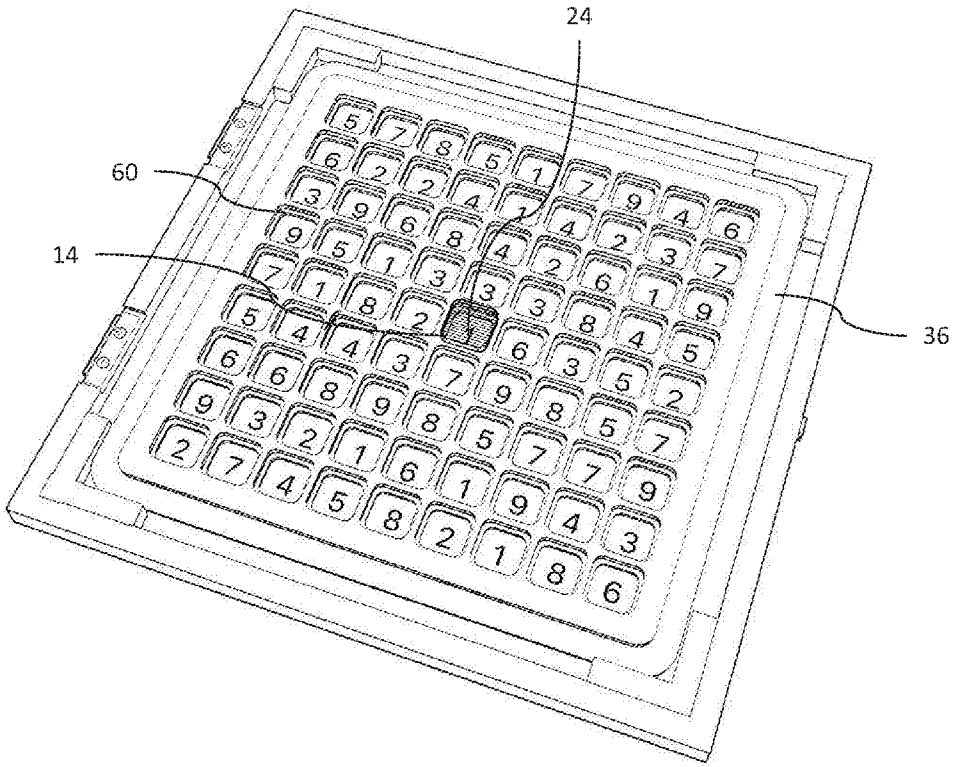

With regard to FIG. 9, a perspective view of a grid pad covering a number map, wherein a transparent colored tile is shown covering a grid number.

Figure 10:
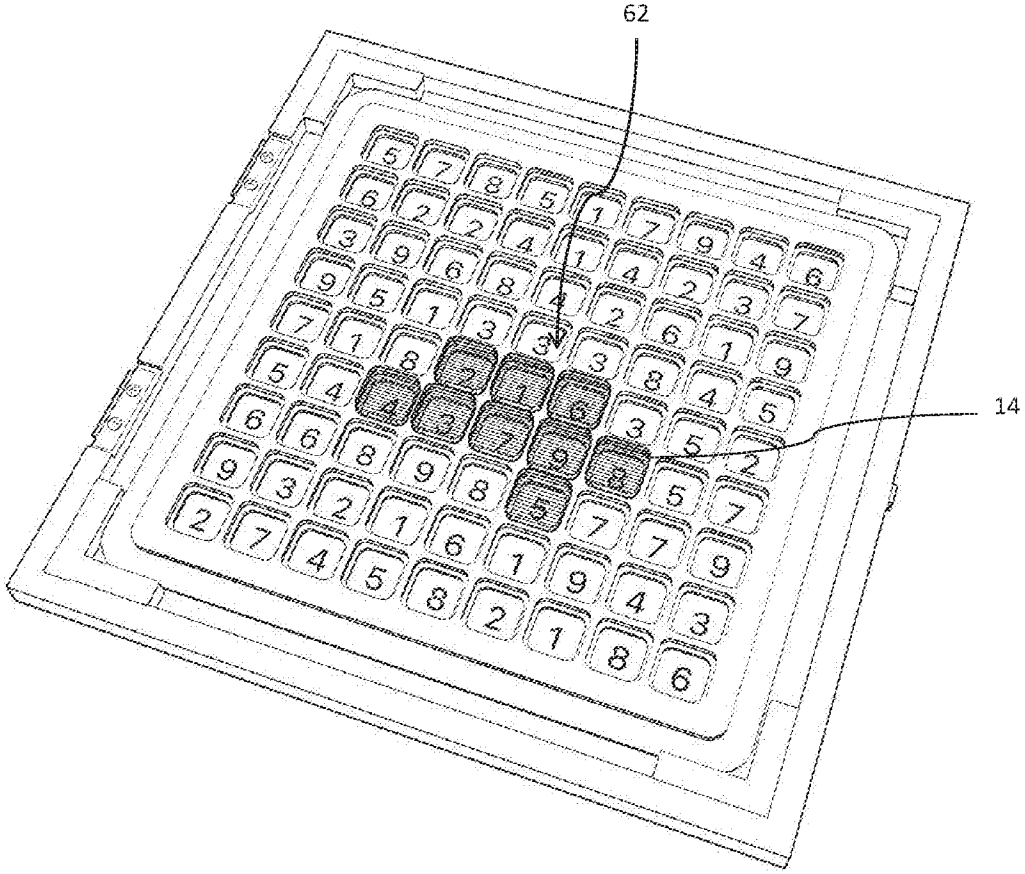

With regard to FIG. 10, a perspective view of a grid pad covering a number map, wherein a set of single-color transparent colored tile is shown covering a completed puzzle unit.

Figure 11B:
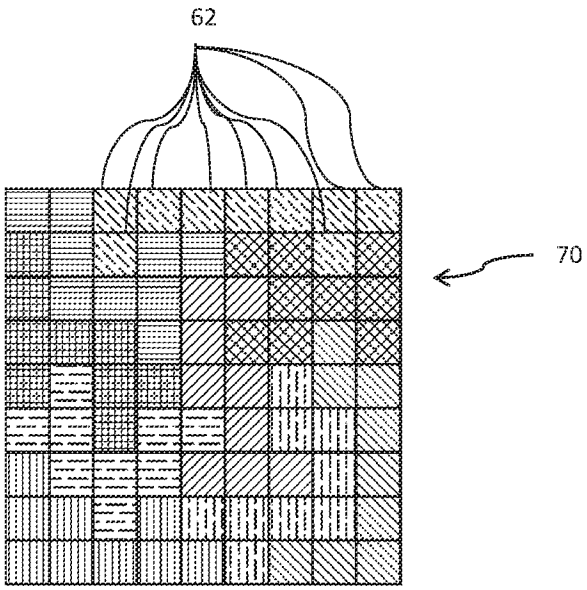
Figure 11A:
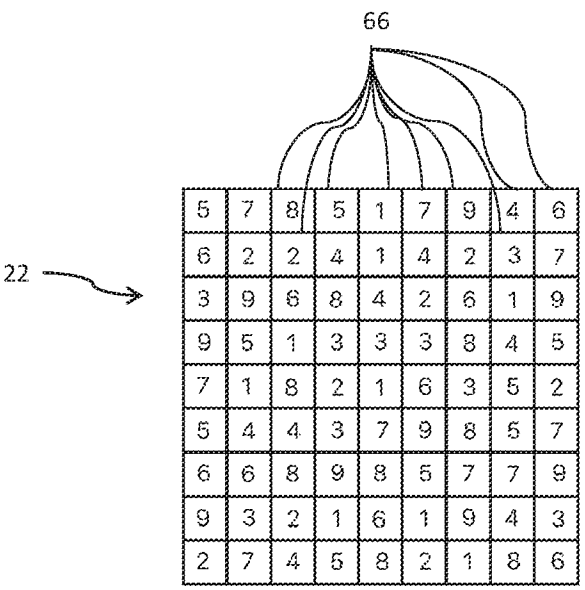

With regard to FIGS. 11A and 11B, a top view of a number map and a multi-colored set of transparent tiles illustrating the solved puzzle of the corresponding number map are shown, respectively.

Figure 12:
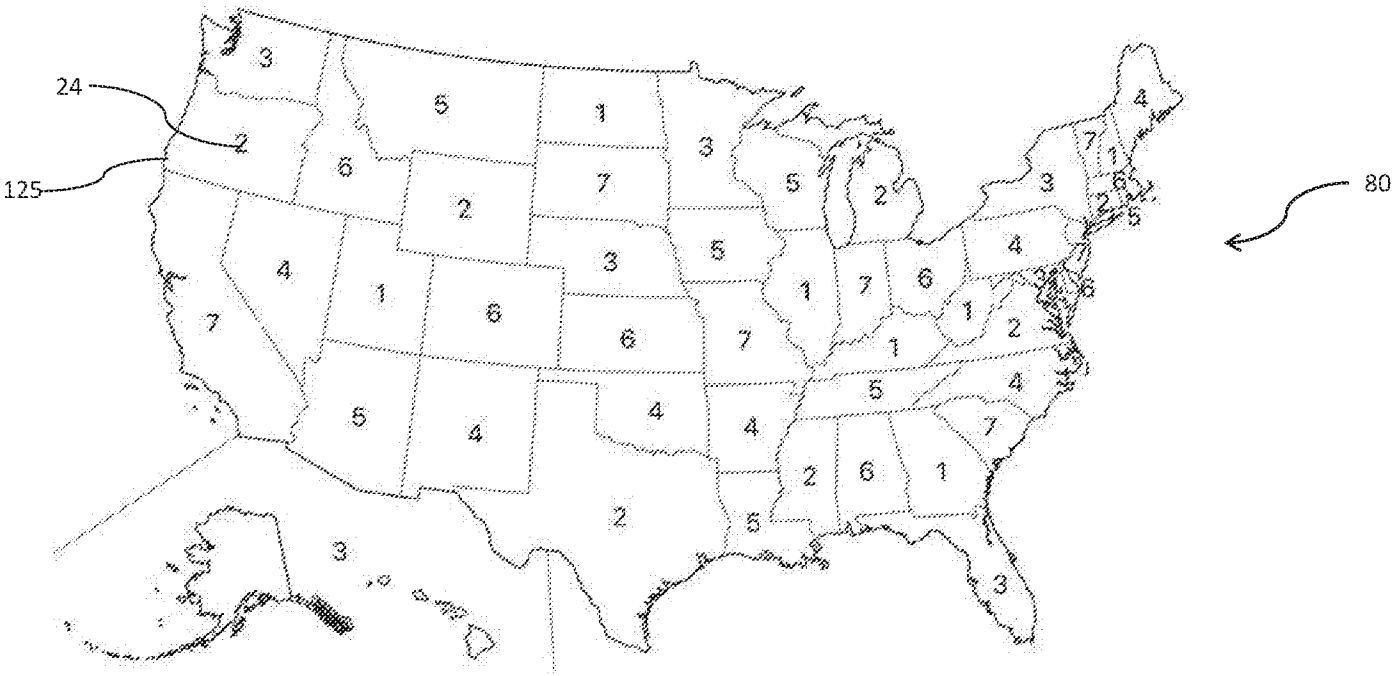

With regard to FIG. 12, a top view of a number map is shown representing the United States of America.

DETAILED DESCRIPTION

Figure 1:
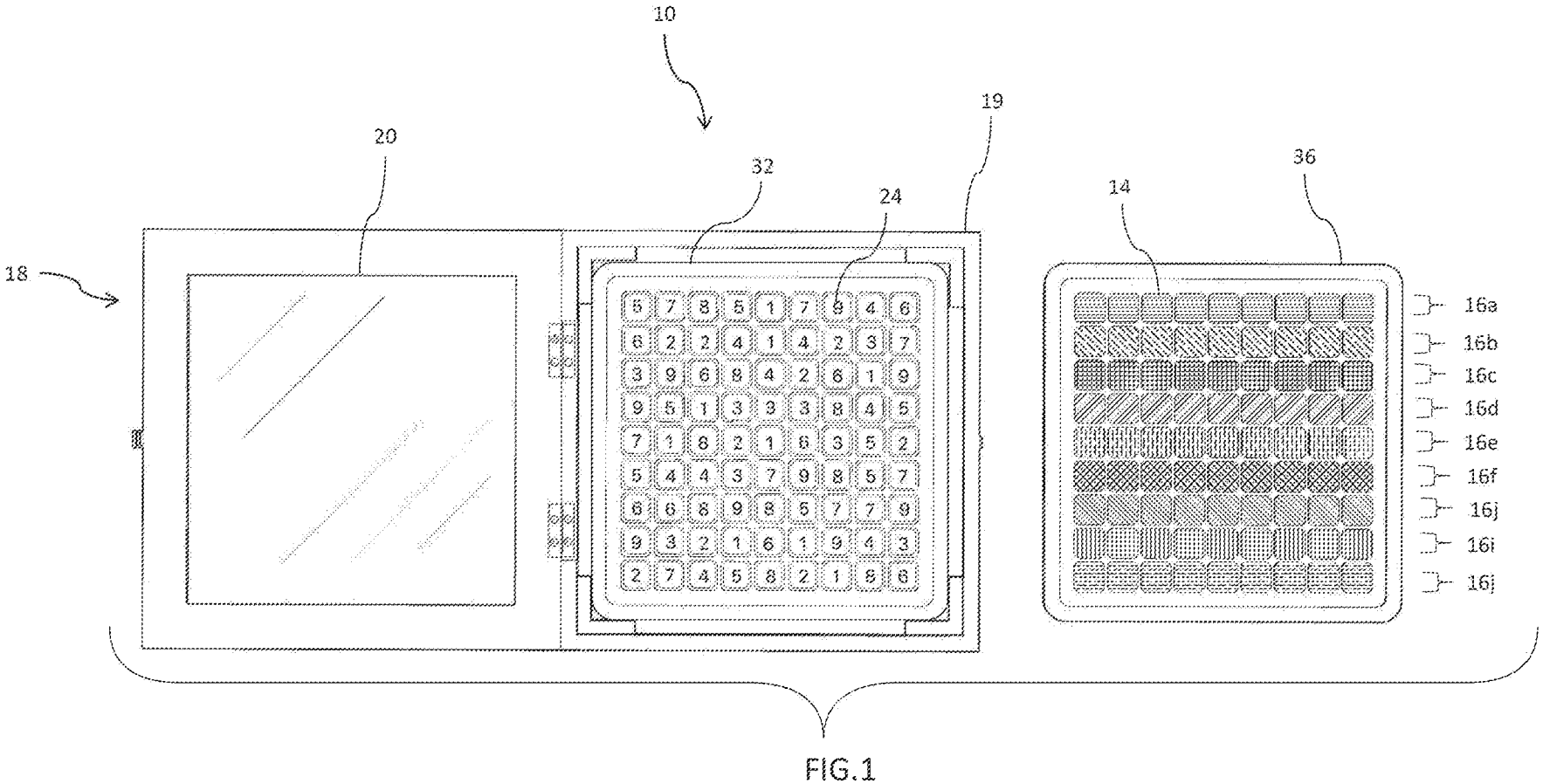

With regard to FIG. 1, a top view of a number puzzle kit 10 is shown. Number puzzle kit 10 includes transparent colored tiles 14, which in one embodiment are placed over grid numbers 24 to designate the grid number 24 as being associated with tile group 16*a-j*. Transparent colored tiles 14 may be of any variety of colored such that they can be distinguished from one another on a puzzle board. Case 18 is designed to hold all components of number puzzle kit 10. Window 20 allows for display of number puzzle kit 10 once a puzzle is solved. Grid pad 36 may overlay a group of grid numbers 24 and may have a male/female connection with grid cover 32 and is contained in frame 19. Each transparent colored tile 14 has a length, width and thickness to fit into a designated portion of grid pad 36. Transparent colored tiles 14 may be comprised of plastic, glass or other material through which visible light may pass.

Figure 2:
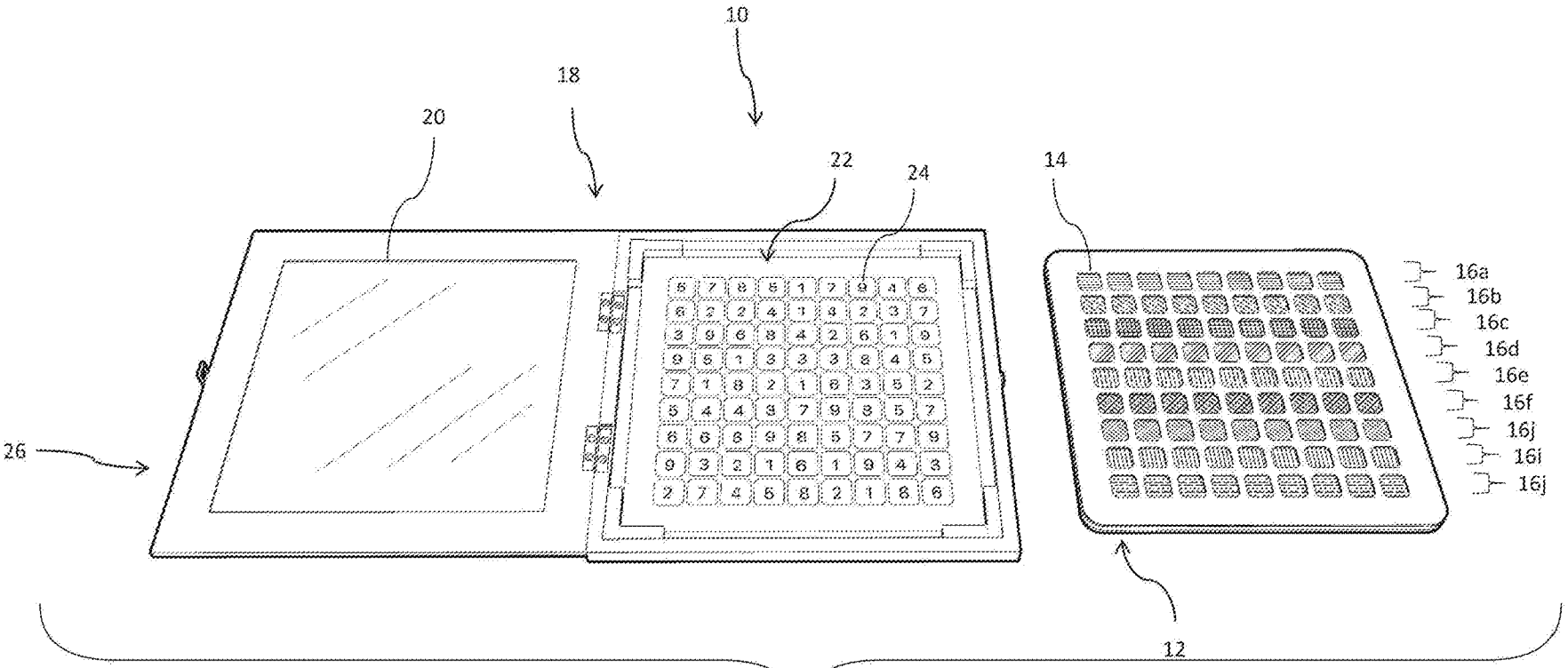

With regard to FIG. 2, a perspective view of a number puzzle kit 10 is shown. A combined grid pad and grid cover 12 is shown enclosing tile groups 16*a-j*. Combined grid pad and grid cover 12 may be placed inside case 18 to cover number map 22 including grid numbers 24. When combined grid pad and grid cover 12 containing tile group 16*a-j* is placed within case 18, door 26 may be closed and fastened to secure the components of number puzzle kit 10 and allow viewing of the puzzle through window 20.

With regard to FIG. 3, an exploded perspective view of a number puzzle kit 10 is shown. Case 18 has a case recess 40 into which all other components of number puzzle kit 10 may fit. The first component placed into case recess 40 is number map 22. In one embodiment, number map 22 is printed on a square sheet of paper. On the square paper is a 9×9 grid consisting of 81 grid sections 25. 9 groups of colored transparent tiles, herein referred to as tile groups 16*a-j*, wherein each tile group 16*a-j* corresponds to a number set 66 (shown in FIG. 11A) the numbers 1 through 9, may be arranged in various configurations on number map 22 to match 9 number sets 66 (shown in FIG. 11A). The 9 number sets will match with individual tile groups 16*a-j* to form contiguous structures on the grid, where each grid number 24 from each number set 66 is connected at an edge of a square grid section in number map 22 to at least one other grid number 24 in a number a particular number set 66. Each number set 66 is sequentially connected on the grid such that each grid number 24 from a single number set 66 shares a side of a grid section 25 with a different grid number 24 from the same number set 66. Each number set 66 is covered by the same colored transparent colored tile 14 from one of tile groups 16*a-j* (Shown in FIG. 11B). The transparent colored tiles 14 may have the same shape as the grid section 25 on the number map 22

To hold transparent colored tiles 14 in place above a grid number 24, grid pad 26 is placed on top of number map 22. Grid pad 36 may be comprised of any hard or flexible material capable of forming a pad over number map 22. Transparent colored tiles 14 may be placed in grid pad 36, wherein each tile corresponds to a grid number 24 on number map 22. Grid pad 36 is capable of accepting a set of multi-colored transparent tiles 34. A 9×9 set of transparent colored tiles 34 may be covered by grid cover 32.

With regard to FIG. 4, a perspective view of case 18 containing transparent colored tiles 14 beneath a grid cover 32 is shown. Components of number puzzle kit 10 can be seen beneath window 20. Door 26 has first fastener component 52 and second fastener component 54 to enclose number map 22, set of multi-colored transparent tiles 34, and combined grid pad and grid cover 12 for display.

With regard to FIG. 5, a perspective view of a 9×9 set of transparent colored tiles 34 is shown. Each transparent tile 14 is part of a tile group 16*a-j*, wherein each tile group 16*a-j* contains 9 transparent tiles 14 of the same color. 9 tile groups 16*a-j* comprise a 9×9 set of transparent colored tiles 34.

With regard to FIG. 6, a perspective view of grid pad 36 is shown. Grid pad 36 has grid pad recesses 60 which are sized and shaped to accept transparent tiles 14. Grid pad recess 60 has a step 61, wherein step 61 comprises a generally square shape sized slightly smaller in width than transparent colored tiles 14. Within step 61 is an aperture to allow visibility of grid number 24 through grid pad recess 60. Step 61 provides a barrier between number map 22 and transparent colored tiles 14. With regard to FIG. 7, a perspective view of a grid pad 36 covering a number map 22 is shown.

With regard to FIG. 8, a perspective view of grid cover 32 and grid pad 36 enclosing 9×9 set of transparent colored tiles 34 is shown. A transparent colored tile 14 is shown enclosed within combined grid pad and grid cover 12. Grid cover 32 has grid cover apertures 53 that are slightly smaller than transparent colored tiles 14 to prevent transparent colored tiles 14 from falling through grid cover aperture 53 and to maintain position within grid pad 36.

With regard to FIG. 9, a perspective view of grid pad 36 covering number map 22 is shown, wherein transparent colored tile 14 is shown placed in grid pad recess 60 covering grid number 24, wherein grid number 24 is visible through transparent colored tile 14.

With regard to FIG. 10, a perspective view of a grid pad 36 covering number map 22 is shown, wherein a tile groups 16*a-j* is shown covering a completed puzzle unit 62. 9 completed puzzle units 62 must be formed to solve a puzzle according to the present disclosure.

With regard to FIGS. 11A and 11B, FIG. 11A shows a top view of number map 22 including a number set 66. FIG. 11B shows a top view of a solved number puzzle 70, including a completed puzzle unit 62, that solves the corresponding puzzle shown in number map 22 of FIG. 11A. To solve a number puzzle according to the present disclosure, every transparent colored tile 14 must be placed over a grid number 24 and every transparent colored tile 14 must be placed adjacent a transparent colored tile 14 of the same color. Each transparent colored tile 14 of the same color must be placed on a different number in a particular number set 66, where each tile group 16*a-j* covers the numbers 1 through 9. Each grid number 24 having the same value on the number map 22 must be covered by a transparent colored tile 14 of a different color. Only one transparent colored tile 14 per grid number 24 is permitted.

Number puzzle kit 10 allows for a wide variety of puzzles to be solved. Alternative embodiments of the present disclosure, such as where the tiles are colored and numbered but not transparent, and the tiles are placed over a number map 22, are contemplated within the present disclosure. A preferred embodiment of the present disclosure includes a square number map 22 having a grid of 9×9 squares, however, other embodiments may include a wide variety of geometric shapes having grids of different shapes and sizes. In alternative embodiments, the concept of locating numbers on the grid in a sequential order and matching them with transparent colored tiles 14 to complete the puzzle game remains the same.

For example, in one embodiment, the number map could be a 4×4 grid with 16 squares in the grid. Alternatively, the number map could have a grid where all grid sections 25 are numbered except for one, while the rules would remain the same. Alternatively, the number map could be a 12×12 square grid. Increasing the size of the grid increases the difficult of solving the number puzzle. In one embodiment, the number map could be a 9×9 triangle, where each side of the triangle would have 9 numbers in triangular grid sections. Alternatively, the number map could be a 9×9 diamond shape, where the grid sections are hexagons, wherein each of the 4 sides of the diamond-shaped number map would have 9 numbers in hexagonal grid sections 25.

Other embodiments, including those that may be performed on a computer, are also contemplated within the present disclosure. Irregular shapes for number maps are also contemplated within the present disclosure. Circular shaped number maps are also contemplated within the present disclosure, where the grid sections 25 and matching transparent colored tiles may be irregularly shaped. Transparent colored tiles 14 may be printed on a 3-d printer according to a particular type of geographic area or feature. Alternatively, when used as a geographical learning tool, the geographical number map 80 could represent a map of the United States of America, as shown in FIG. 12, where each state is a grid section 125, and grid numbers 24 are matched with states representing state grid sections 125. In a computerized version of the puzzle game, tiles would be virtual, however, the concept of the puzzle game would remain the same.

Although exemplary embodiments have been shown and described, it will be clear to those of ordinary skill in the art that a number of changes, modifications, or alterations to the disclosure as described may be made. All such changes, modifications, and alterations should therefore be seen as within the scope of the disclosure.

What is claimed is:

1. A number puzzle, comprising:

a case including a frame and a door having a window; wherein the frame and the door are connected by a hinge;

the frame having a frame recess, defined by a plurality of walls;

the frame recess being shaped and sized to contain a number map;

the number map containing a grid comprised of grid sections;

wherein a plurality of number sets are comprised of grid numbers, wherein the grid numbers are sequential integers beginning at 1 and each number set contains identical numbers;

wherein each grid number is contained in a grid section;

wherein each number set is connected on the grid such that each number from a number set shares a side of the grid section with a different number from the number set;

the frame recess containing a grid pad on top of the number map for receiving a plurality of transparent colored tiles;

wherein the grid pad has grid pad recesses; wherein each grid pad recess accepts a single transparent colored tile; wherein the grid pad recess has a step to separate the transparent colored tile from the number map; the grid pad having apertures to allow for visibility of numbers on the number map;

wherein the grid pad mates with a grid cover; wherein the grid cover has grid cover apertures having a width less than that of a transparent colored tile to prevent the plurality of transparent colored tiles from being removed from the grid pad;

wherein each set of numbers on the grid correspond to a set of transparent colored tiles of a single color that together comprise a tile group;

wherein a completed number puzzle has all grid numbers from each number set being covered by the transparent colored tile from the tile group corresponding to the number set.

2. The number puzzle of claim 1, wherein the grid is symmetrical.

3. The number puzzle of claim 1, wherein the grid comprises a 9×9 square and contains 81 grid sections that contain 81 grid numbers.

4. The number puzzle of claim 1, wherein the transparent colored tiles are unmarked.

5. The number puzzle of claim 1, wherein the case includes a male/female fastener on an outer portion of the frame and an outer portion of the door.

6. A puzzle system, comprising:

a case including a frame and a door having a window; wherein the frame and the door are connected by a hinge;

the frame having a frame recess, defined by a plurality of walls;

the frame recess being shaped and sized to contain an indicia map;

the indicia map containing a grid comprised of grid sections;

wherein a plurality of indicia sets are comprised of grid indicia, wherein the grid indicia are sequential indicia;

wherein each grid indicia is contained in a grid section;

wherein each indicia set is connected on the grid such that each indicia from a indicia set shares a side of the grid section with a different indicia from the indicia set;

the frame recess containing a grid pad on top of the indicia map for receiving a plurality of transparent colored tiles;

wherein the grid pad has grid pad recesses; wherein each grid pad recess accepts a single transparent colored tile; the grid pad having apertures to allow for visibility of indicia on the indicia map;

wherein the grid pad mates with is a grid cover; wherein the grid cover has grid cover apertures having a width less than that of a transparent colored tile to prevent the plurality of transparent colored tiles from being removed from the grid pad;

wherein each set of indicia on the grid correspond to a set of transparent colored tiles of a single color that together comprise a tile group;

wherein a completed indicia puzzle has all grid indicia from each indicia set being covered by the transparent colored tile from the tile group corresponding to the indicia set.

7. The puzzle system of claim 6, wherein the grid pad recess has a step to separate the transparent colored tile from the number map.

8. The puzzle system of claim 7, wherein the indicia are numbers and the indicia sets are comprised of numbers beginning at 1, wherein each indicia set contains identical numbers.

* * * * *